US005782303A

United States Patent [19]

Christian

[11] Patent Number: 5,782,303

[45] Date of Patent: Jul. 21, 1998

[54] METHOD AND APPARATUS FOR DRAINING FLUIDS FROM TUBING

[76] Inventor: J. B. Christian, 26 Holly Lake Dr., Ellisville, Miss. 39437-9801

[21] Appl. No.: 707,424

[22] Filed: Sep. 4, 1996

[51] Int. Cl.[6] ..... E21B 21/00

[52] U.S. Cl. ..... 166/311; 166/154; 166/334.3; 166/373

[58] Field of Search ..... 166/369, 381, 166/153, 154, 311, 373, 68, 334.3

[56] References Cited

U.S. PATENT DOCUMENTS

| | | | |
|---|---|---|---|
| 3,752,230 | 8/1973 | Bernat et al. | 166/98 |
| 4,103,739 | 8/1978 | Hall | 166/105 |
| 4,519,457 | 5/1985 | Holland et al. | 166/317 |
| 4,624,307 | 11/1986 | Kinley et al. | 166/55.3 |
| 5,018,581 | 5/1991 | Hall | 166/68 X |
| 5,372,197 | 12/1994 | Wacker | 166/311 |

*Primary Examiner*—Roger J. Schoeppel

[57] ABSTRACT

An apparatus which includes an external housing (10) and a slotted internal sleeve (26) machined from cylindrical lengths of hollow metal pipe stock, and one or more partially-hollowed-out plug screws (16). This apparatus uses no seals or O-rings. The apparatus is attached between a tubing string of a well and a big bore pump. When activated, the apparatus permits fluids to drain from well tubing. The apparatus has only one moving part and is activated by pulling upward on sucker rods of a well, an action which causes the top of a big bore pump plunger to make contact with the sleeve and move the sleeve upward within the housing. The sleeve is secured inside the housing by one or more partially-hollowed-out plug screws which are sheared when the contact is made, exposing at least one opening. The opening in the sleeve aligns with the hole in the partially-hollowed-out plug screw caused by the shearing. The alignment of the opening allows fluid to drain from inside a tubing string into the casing of a well when the tubing string is pulled from a well. The apparatus remains attached between the tubing string and the big bore pump and is retrieved when the tubing string and pump are pulled to the surface.

10 Claims, 8 Drawing Sheets

METHOD AND APPARATUS FOR DRAINING FLUIDS FROM TUBING

BACKGROUND—FIELD OF INVENTION

This invention relates to wells which use big bore pumps, specifically to a method and apparatus for draining fluids from well tubing.

BACKGROUND OF THE INVENTION

This invention relates to draining of fluids from well tubing into well casing. More specifically, this present invention relates to a method and apparatus for draining fluids from inside well tubing without requiring devices which use O-rings or rubber seals and without requiring activation by pump pressure applied at the surface required by previously known devices.

Drilling new wells has become a fairly standardized event; that is, a hole is drilled and casing is installed and tubing is placed inside the casing to convey the production of the well to the surface. The use of big bore pumps in some wells to start and maintain well production is common.

One type of previously known "downhole" tool used for the purpose of draining well tubing is referred to in the industry as a "drain sub." Drain subs are attached to big bore pumps to be activated to release fluids from inside well tubing when pumps are inoperable and need to be brought to the surface. This type of tool is used to create drain holes in well bores, so that fluid inside the tubing string can be released. Such a drain sub is for the purpose herein referred to as a well tubing drain apparatus.

The second type of previously known tool for draining well tubing is referred to in the industry as a "perforator." There are various types of perforators utilizing various methods of operation. One such perforator is a wireline-conveyed explosive perforator disclosed in U.S. Pat. No. 4,624,307 to Kinley et al (1986). Wireline-conveyed perforators are lowered into a well tubing to make holes in the tubing through which fluids can drain.

Frequently it is necessary to drain fluids from well tubing, so that trapped fluids can escape from well tubing prior to pulling a tubing string from a well. Well pumps which become plugged, or are otherwise inoperable, require the tubing string to be pulled from the well so the pump can be retrieved.

Previously developed means of draining fluid, cited in U.S. Pat. No. 3,752,230 to Bernet et al (1973); U.S. Pat. No. 4,103,739 to Hall (1978); U.S. Pat. No. 4,519,457 to Holland et al (1985); U.S. Pat. No. 5,018,581 to Hall (1991); and, U.S. Pat. No. 5,372,197 to Wacker (1994); were designed for either insert or rod pumps, or for dislodging stuck insert or rod pumps. The invention is designed for use in big bore pumps or tubing pumps.

U.S. Pat. No. 3,752,230 to Bernet et al (1973) is a fishing tool developed to pull stuck items from a well; not to drain a tubing string. This tool requires pressurization to activate it and has a valve opening used to eliminate pressurized fluid. The many parts, valves, and seals which comprise the Bernet tool allow fluid to pass through it for the sole purpose of activating said tool and not for creating drain holes.

U.S. Pat. No. 4,103,739 to Hall (1978) is a sand release apparatus for an insert or rod pump used to remove sand prior to pulling an inoperable pump which is stuck in a tubing string. This apparatus does not create drain holes in a tubing string. The Hall apparatus, located mid-level inside an insert or rod pump inside well tubing, is activated by surface pressure from a pump truck and by pulling up on sucker rods. This permits fluid above a sand deposit to flush sand through an insert or rod pump. This sand release apparatus requires shear pins and seals.

U.S. Pat. No. 4,519,457 to Holland et al (1985) is an oil well standing valve, a production valve, located below an insert or rod pump. This valve permits fluid from outside a tubing string to flow into the bottom of an insert or rod pump. The drain feature of this valve must be activated by a wireline tool when the wireline tool retrieves the valve. When a pump needs repair, and is removed, the Holland valve can either be removed or activated by wireline if it is otherwise necessary to remove a tubing string from a well casing. Activation or removal of this valve is not necessary to remove an insert or rod pump. The valve is designed to permit well tubing to be unplugged from inside a tubing string in the event a tubing string otherwise must be pulled. The valve operates as a plug during well shut down.

U.S. Pat. No. 5,018,581 to Hall (1991) appears to be an improved version of U.S. Pat. No. 4,103,739 to Hall (1978). The Hall (1991) tool, located inside a rod or insert pump, is used to unstick sand-locked pumps when the tool described in Hall (1978) does not work. When the sand release tool described in Hall (1978) does not work, the Hall (1991) version of the tool permits two internal sleeves inside the tool to be rotated. This is accomplished by rotating sucker rods clockwise at the surface, thereby unthreading an insert or rod pump from its anchor base. The shear pins added in Hall (1991) permit this tool and the pump to become disengaged. This tool does not create drain holes for fluids to flow out of a tubing string.

U.S. Pat. No. 5,372,197 to Wacker (1994) is a tubing unloader tool designed for use with a stuck insert or rod pump. This unloader has many parts, including O-rings and seals. This tool is activated to drain fluid when it is necessary to remove a tubing string along with a stuck insert or rod pump. This unloader tool requires axial direction to activate certain features, and requires pulling upward on a tubing string to create drain holes in the tubing. This tool is designed to act as a "seat" which accepts a blow of a previously raised tubing string. The tubing string is dropped to break tubing anchors at the bottom of a well. This permits the entire tubing string and insert or rod pump to be pulled to the surface.

Prior to this present invention, all known well tubing drain apparatuses attached to big bore pumps used for creating drain holes in well bores have been designed to use O-rings and rubber seals to keep the apparatus from leaking prior to activation. And, some such heretofore known apparatuses require activation by pump pressure applied from the surface of a well.

It is possible to pull tubing from a well without draining the fluids from inside the tubing. Pulling tubing without a drain hole is less costly than using a tool to drain the tubing, but, several problems occur when tubing is pulled without a drain hole. The time required to pull tubing out of a hole is increased due to the problem of trying to contain the fluids trapped in the tubing. A bucket designed to wrap around the connections of the tubing can be used. A hose is attached to the bottom of the bucket at one end with the other end attached to a tank which is mounted on a truck. When a tubing string section is unscrewed the fluid is transferred to the tank. Some of the fluids invariably spill onto the surface. Clean-up of such spillage is mandated by state regulation, and if contamination occurs outside the location of the well, clean-up is mandated by the Environmental Protection Agency.

This present invention provides a method and apparatus which is less costly to use than other known well tubing drain apparatuses, as: (1) it does not need to be replaced due to failure of its parts before activation is needed, and (2) it does not require applying pump pressure from the surface to activate it. Further, this present invention is less costly to use than wireline-conveyed perforators, as: (1) it does not require hiring and rigging up a wireline truck with a wireline operator and helper to use it; and (2) it does not require the use of bullets which can fail to fully penetrate well tubing when fired. The present invention is even less costly to use than pulling tubing which has not been drained.

This present invention provides a new type of well tubing drain apparatus which does not require the use of O-rings or the use of rubber seals and which has only one moving part.

Heretofore known tools for draining well tubing suffer from a number of disadvantages which result in a loss of well production time. The following describes the disadvantages of well tubing drain apparatuses and wireline perforators and provides the reasons the present invention is less costly to use than each of these types of tools:

(a) Existing well tubing drain apparatuses contain rubber seals and O-rings which are not always reliable, so are prone to leaking. Such leakage requires well shut down prior to the big bore pump becoming inoperable and a loss of well production to repair or replace the leaking device. This is not an issue with the present invention as it does not contain rubber seals or O-rings.

(b) Most existing well tubing drain apparatuses require thousands of pounds of pump pressure from the surface to activate the drain mechanism. Sometimes, this pump pressure destroys the tubing. This present invention does not require surface pressure to activate it.

(c) When pump pressure from the surface is required to activate the drain mechanism of existing well tubing drain apparatuses, a pump truck and operators are needed to accomplish this. This present invention eliminates the expense of waiting for and using a pump truck.

(d) Cross-over subs are required in order to use many existing well tubing drain apparatuses. The present invention eliminates the need for cross-over subs, when larger sizes of the present invention are used.

(e) Existing well tubing drain apparatuses which contain rubber seals and O-rings can be affected by differences in pressure between well casing and well tubing. Such pressure can cause the rubber seals and O-rings to leak. This is not an issue with the present invention which does not contain rubber seals or O-rings.

(f) Premature activation of existing well tubing drain apparatuses due to a low level of shear force, requires well shut down and loss of well production. The moderate shear force required to activate the present invention eliminates premature activation and loss of well production.

(g) Existing well tubing drain apparatuses and wireline perforators are comprised of several moving parts which reduce their reliability. This is not an issue with the present invention which has only one moving part.

(h) The activation of existing well tubing drain apparatuses can result in movement of parts in a way which can cause the drain hole to partially or completely close. The present invention is designed with a collet and slots on its internal sleeve which eliminate the possibility of such movement following activation and the resulting cost of such a malfunction.

(i) The hiring and rigging up of a wireline truck requiring two people, one wireline operator and one helper, is needed to use a wireline perforator. A wireline truck is not required when the present invention is used.

(j) Wireline perforators which use solid bullets, such as that disclosed in U.S. Pat. No. 4,624,307 to Kinley et al (1986) can become lodged in the tubing when the bullets do not fully penetrate the tubing when fired, thus causing such perforator to become stuck in the tubing. In such cases, the wire must be cut and a second wireline perforator lowered into a well. This is a time-consuming process which the present invention avoids.

ADVANTAGES OF THIS INVENTION

Accordingly, several advantages of this present invention are:

(a) to provide a well tubing drain apparatus which does not contain rubber seals or O-rings, the result being a well tubing drain apparatus which does not leak and cause premature well shut down to fix such leakage, resulting in an immediate economic savings;

(b) to provide a well tubing drain apparatus which can be activated by using moderate upward force on the sucker rods which raises the plunger in a big bore pump, instead of thousands of pounds of pump pressure from the surface which sometimes destroys tubing;

(c) to provide a well tubing drain apparatus which does not require a pump truck and operators at a well site in order to provide pump pressure to activate the apparatus, resulting in an immediate economic savings;

(d) to provide a well tubing drain apparatus which is designed so that it does not require use of a cross-over sub when larger sizes of the well tubing drain apparatus are used, the result being an immediate economic savings;

(e) to provide a well tubing drain apparatus which is not affected by differences in pressure between well casing and well tubing which can cause rubber seals and O-rings to leak, because no seals or O-rings are used which could be affected by such pressure;

(f) to provide a well tubing drain apparatus which requires moderate shear force to activate therefore eliminating premature activation and the need to shut down the operation of a well for premature activation, which results in immediate economic savings;

(g) to provide a well tubing drain apparatus which has only one moving part, an internal sleeve, activated only when a plunger of a big bore pump is raised sufficiently to come into contact with the sleeve, resulting in a reliable method of draining fluids from tubing;

(h) to provide a well tubing drain apparatus with a slotted internal sleeve which is milled with a collet near the top of the slotted internal sleeve and an accommodating groove machined on the inside diameter of the external housing to prevent internal sleeve movement after the well tubing drain apparatus is activated;

(i) to provide a well tubing drain apparatus which can be attached to a big bore pump, so that a wireline truck and wireline operator and a helper are not required, resulting in an immediate economic savings; and (j) to provide a well tubing drain apparatus which opens a well bore when activated, thus avoiding the use of explosives to penetrate well tubing, eliminating the problem of misfiring and the time and cost of lowering another wireline perforator into a well.

The draining of fluid from tubing before a tubing string is pulled from a well eliminates the problem of contamination of the soil from spilling fluids onto the ground at the surface, thus eliminating the time-consuming, and therefore, costly, legally-mandated clean up. Because the well tubing drain apparatus is placed in a well between the bottom end of the tubing string and the top of a big bore pump, it takes less time and less labor to use and is a more efficient and less costly method of draining fluid from well tubing. Getting wells back into production is extremely important. For example, due to the high demand for oil, producers can suffer significant financial loss when wells are out of production.

Further, it is believed that the well tubing drain apparatus works equally well on both low volume and high volume wells.

OBJECTS OF THIS INVENTION

It is a principal object of this invention to provide a tubing drainage capability for wells which use big bore pumps by utilizing a method and apparatus which will not allow leakage while the big bore pump continues operating and before activation is desired. Further objects and advantages of this invention will become apparent from a consideration of the drawings and ensuing description of the apparatus.

SUMMARY OF THE INVENTION

This invention in its preferred embodiment, is a well tubing drain apparatus consisting of an external housing, a slotted internal sleeve, and a tapered, partially-hollowed-out, self-sealing plug screw, with an outside diameter of the housing which permits the apparatus to fit into a well casing. Both the bottom and the top of the well tubing drain apparatus are threaded so the top of the apparatus can be screwed to the bottom of a tubing string and the bottom of the apparatus can be screwed to the top of a big bore drain pump prior to lowering into a well. The external housing has a groove in its inside diameter and the slotted internal sleeve has a collet near its top. When a big bore pump, with the attached well tubing drain apparatus, is lowered on a tubing string into an appropriate position in a well, the big bore pump can be activated.

A big bore pump with the attached tubing drain apparatus remains in a well until the pump fails to operate properly. A work-over rig is placed over the well so the tubing drain apparatus can be activated. Activation creates a drain in the well bore, then the tubing string is pulled with the inoperative pump and attached well tubing drain apparatus.

In its preferred embodiment, the well tubing drain apparatus is activated when a work-over rig is placed over a well-head. Sucker rods, extending from a plunger inside a big bore pump to the surface, are attached to a pulling motor. The moderate upward force created by this action from the surface causes the top of the plunger of a big bore pump to make contact with the slotted internal sleeve inside the external housing of the tubing drain apparatus. This moderate upward force causes the tapered, partially-hollowed-out, self-sealing plug screw, holding the slotted internal sleeve inside the external housing, to shear. As the slotted internal sleeve slides upward and the tapered, partially-hollowed-out, self-sealing plug screw is sheared, an elongated opening in the internal sleeve becomes aligned with the newly-exposed opening through the now sheared plug screw in the external housing. The moderate upward force causes the collet in the slotted sleeve to pop out of the groove in the inside diameter of the housing. Since the collet is now above the groove, the spring pressure from the slotted internal sleeve caused by the smaller diameter of the housing holds the sleeve in place. This allows fluid from inside a well tubing to drain into the well casing through the newly-exposed opening in the well bore. As a tubing string is pulled to the surface by a work-over rig, the fluid empties from the tubing, therefore, the tubing is dry by the time it reaches the surface. The invention remains in place as the tubing and the big bore pump reach the surface.

For environmental reasons, it is no longer feasible to pull tubing which contains fluids, a situation commonly known as "wet tubing," because legally-mandated clean up would be required. Further, to pull wet tubing requires more time and labor and additional down time for a well.

There is financial savings when this invention is used because no cross-over sub is needed with the preferred embodiment of this invention. And, there is a financial savings because a pump truck is not needed at a well site to activate the invention because the invention is not activated by pressure from the surface. This invention has no O-rings and no rubber seals, so there are no leaks which would require tubing to be pulled prematurely while a big bore pump is operable. As the invention does not require the use of any rubber materials, there are no failures or leakage from the use of rubber. The shear force required to activate this invention is a moderate upward force, so there is no premature activation which would result in the necessity to pull a tubing string while a big bore pump is still operable.

SUMMARY OF VARIATIONS

While the above summary of the preferred embodiment describes many specificities, these should not be construed as limitations on the scope of the invention, but rather as an exemplification of one preferred embodiment thereof. Examples of variations to accommodate varying pump sizes and well conditions are: The length and diameter of the external housing and the internal sleeve can vary. The number, size and location of the window, the slots in the internal sleeve, the flat, and the partially-hollowed-out plug screw can vary. The location, size, and shape of the collet and groove can vary. The invention can be manufactured without (a) windows, (b) flats, and (c) the collet and groove. The tolerance between the inside diameter of the housing and the outside diameter of the sleeve can vary. To accommodate small pump sizes, the lower end of the external housing will seal through the use of self-sealing external threads, instead of sealing on a shoulder of the housing.

Accordingly, the scope of the invention should be determined not by the embodiment illustrated, but by the appended claims and their legal equivalents.

BRIEF DESCRIPTION OF THE DRAWINGS

In the drawings, figures with closely related views have the same number, but different alphabetic suffixes.

REFERENCE NUMERALS IN DRAWINGS

| | |
|---|---|
| 2 Tubing String | 5 Sucker Rod |
| 3 Well Tubing Drain Apparatus | 6 Connector |
| 4 Big Bore Pump | 7 Top of Plunger |
| 8 Plunger | 22 Threaded Hole in Housing |
| 10 External Housing | 24 Top End of Housing |
| 11 Outside Diameter of Housing | 25 Bottom End of Housing |
| 12 Self-Sealing Threads on Inside Diameter of Housing | 26 slotted Internal Sleeve |
| 13 Inside Diameter of Housing | 27 Outside Diameter of Sleeve |
| 14 Flat | 28 Top End of Sleeve |
| 16 Partially-Hollowed-out Plug Screw | 29 Collet near Top End of Sleeve |
| 18 Groove | 30 Bottom End of Sleeve |
| 19 Shoulder on Housing | 31 Slots at Top End of Sleeve |
| 20 Threads on Outside Diameter of Housing | 32 Threaded Hole in Sleeve |
| | 34 Window Cut Out in Sleeve |
| | 36 Sheared Plug Screw Hole |

DETAILED DESCRIPTION OF THE PREFERRED EMBODIMENT

It is an object of this invention to provide one or more of the following desirable features not heretofore known or used:

1. A well tubing drain apparatus for putting a drain hole in a well bore so that tubing can be removed without fluid being retained therein, designed with only one moving part, and without O-rings or rubber seals to eliminate leakage.
2. A well tubing drain apparatus activated without surface pump pressure, eliminating premature activation, thus allowing a drain hole in a well bore to be created only when wanted.
3. A well tubing drain apparatus which eliminates the need for cross-over subs.
4. A well tubing drain apparatus which is not affected by differences in pressure between well casing and well tubing.
5. A well tubing drain apparatus which can attach to tubing and big bore pumps worldwide because universal threading is used.
6. A well tubing drain apparatus which is secured and locked by use of a partially-hollowed-out plug screw machined with self-sealing threads, and, a groove and collet.
7. A well tubing drain apparatus which saves well servicing time and expense, when a pump is operable, by eliminating the need to pull tubing for leakage of the tubing drain apparatus.

These and other specific objects will be apparent from the following descriptive matter when taken in conjunction with the drawings.

The Apparatus Prior to Activation

Figure 1:
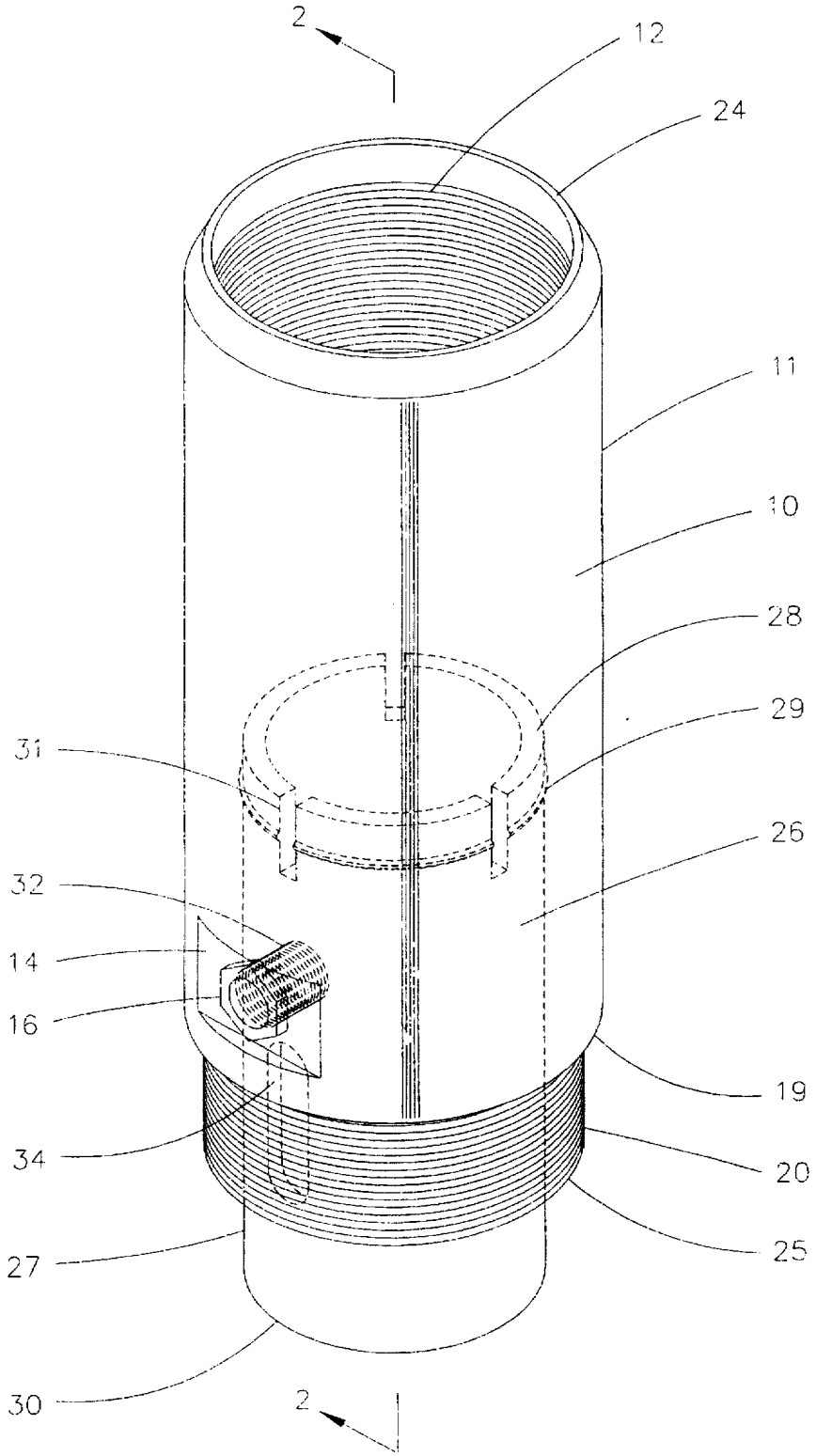
FIG. 1 shows the well tubing drain apparatus, prior to activation, in a longitudinal isometric view with hidden lines, illustrating the external housing and slotted internal sleeve in their secured and locked position through use of a partially-hollowed-out plug screw and a collet and groove.
Figure 2A:
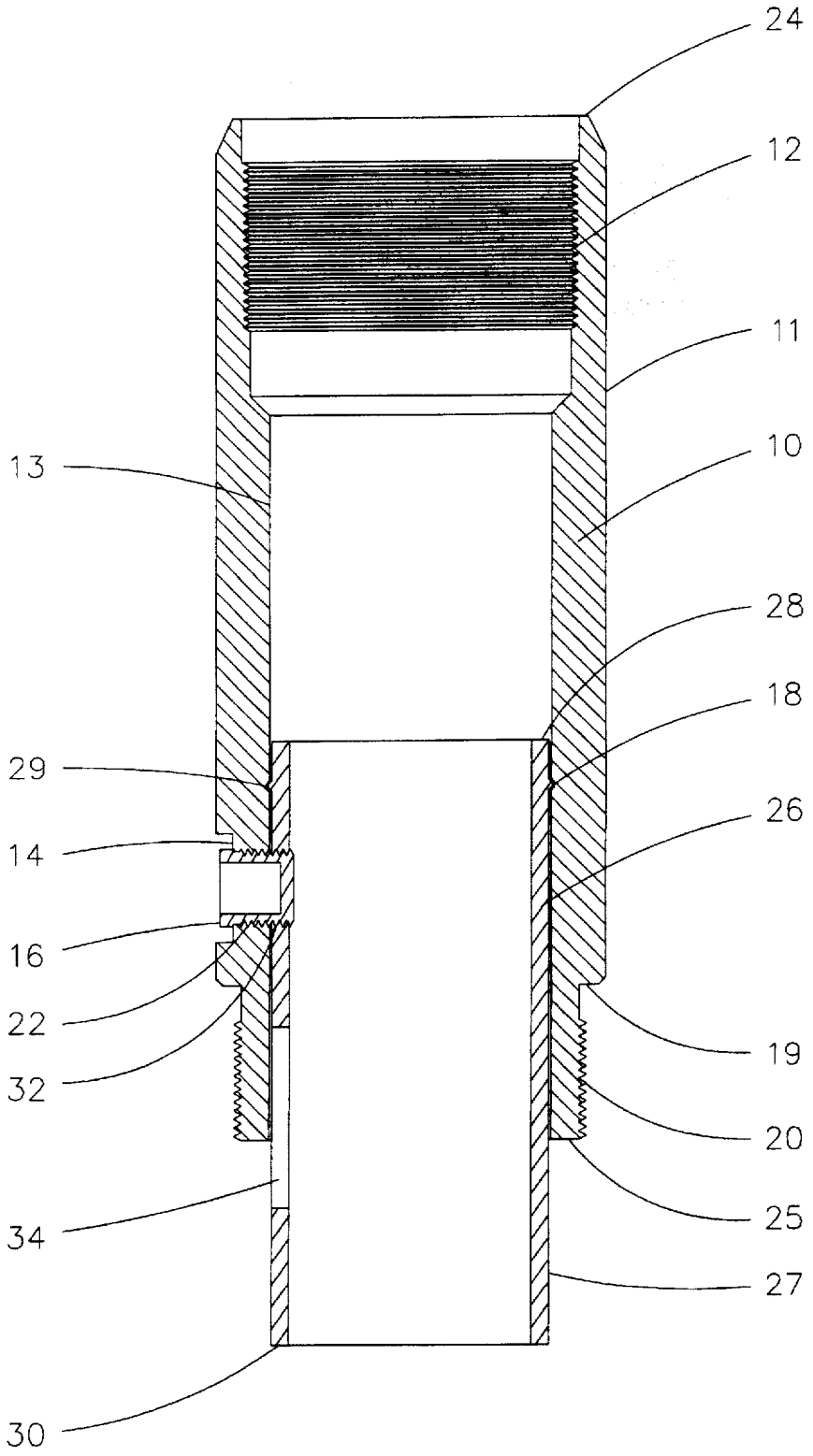
FIG. 2A shows the well tubing drain apparatus, prior to activation, in a longitudinal sectional view, illustrating the external housing and slotted internal sleeve in their secured and locked position through use of a partially-hollowed-out plug screw and a collet and groove.
Figure 2B:
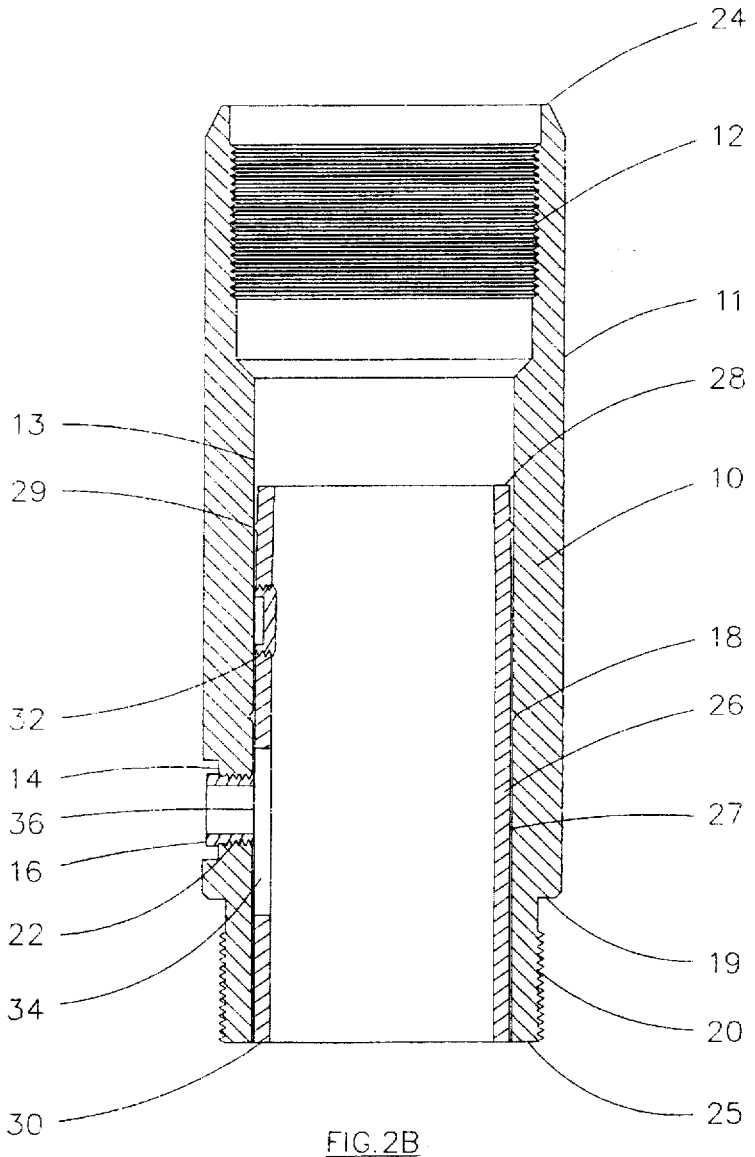
FIG. 2B shows the well tubing drain apparatus, after activation, in a longitudinal sectional view illustrating the slotted internal sleeve, with the collet, in its uppermost position within the external housing and the sheared partially-hollowed-out plug screw as the drain hole.
Figure 2C:
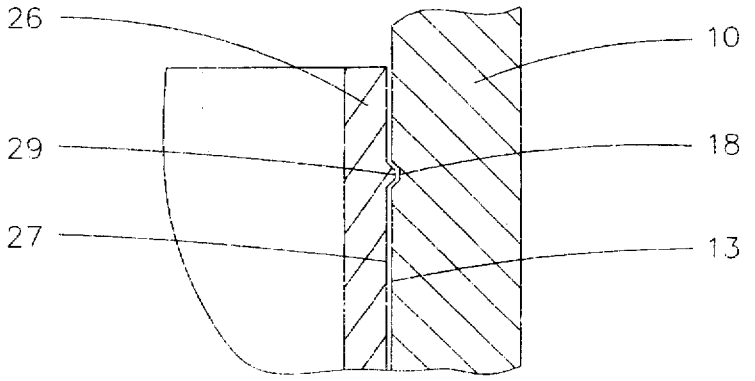
FIG. 2C shows a longitudinal sectional large-scale view, prior to activation, of the groove and collet portion of the well tubing drain apparatus.
Figure 3A:
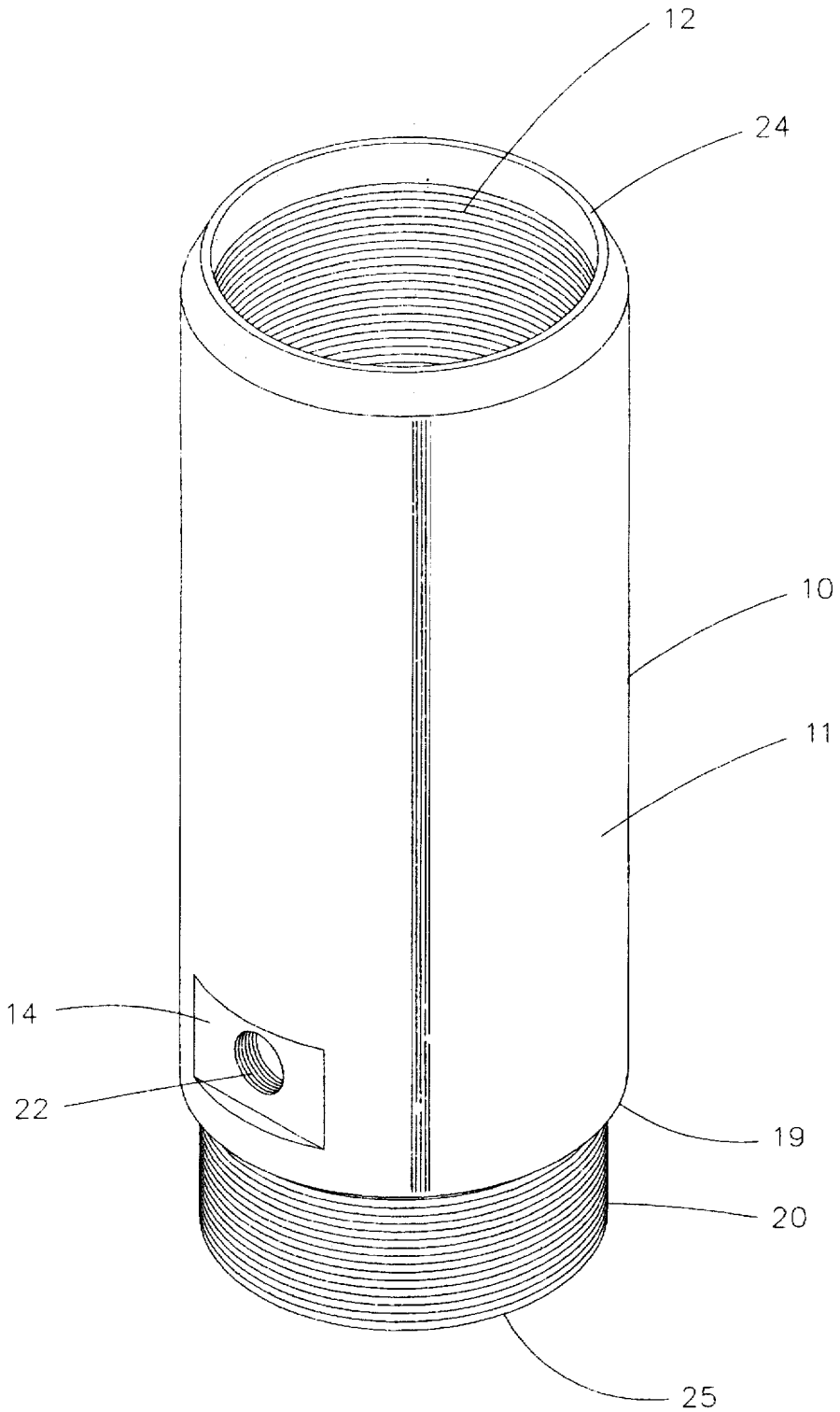
FIG. 3A shows the external housing portion of the well tubing apparatus in a longitudinal view.
Figure 3B:
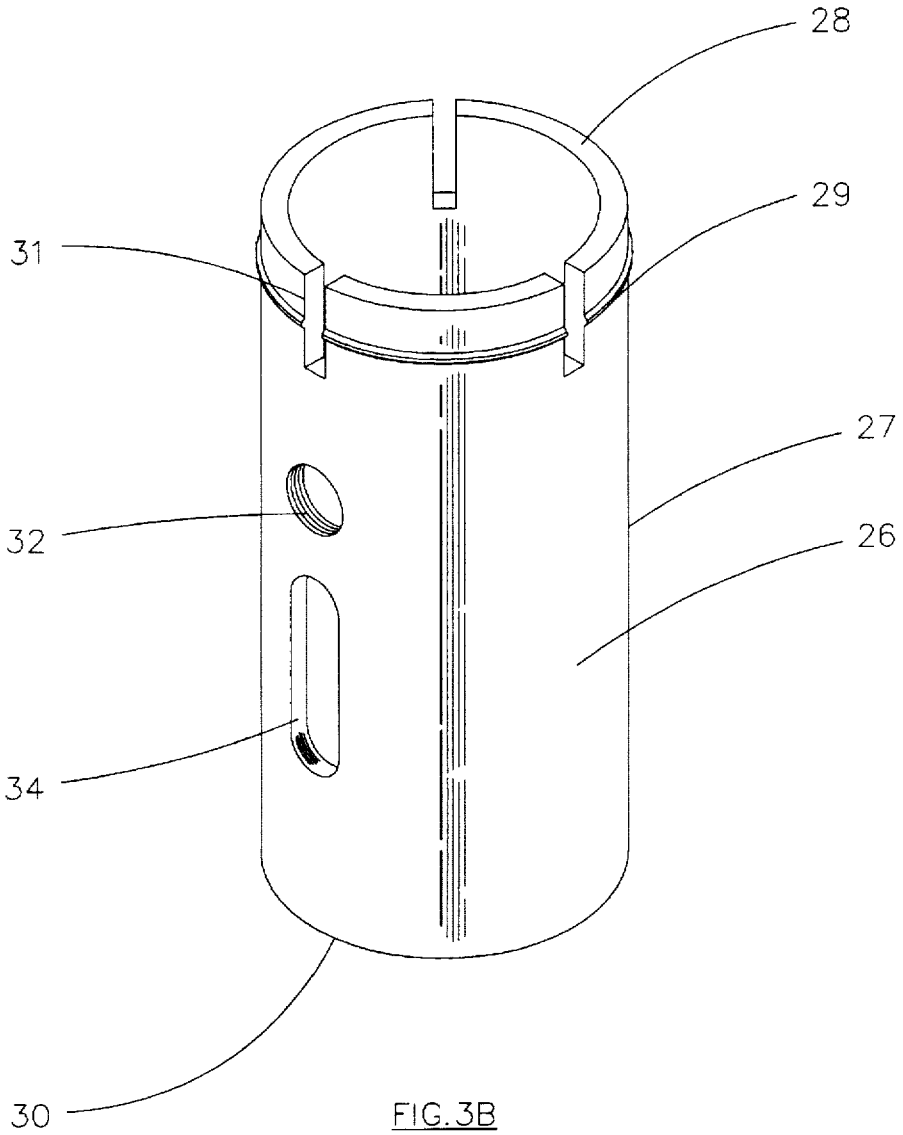
FIG. 3B shows the slotted internal sleeve and collet portion of the well tubing apparatus in a longitudinal view.
Figure 3C:
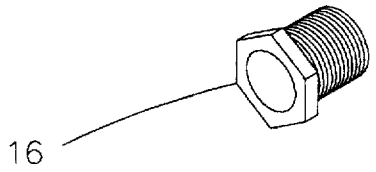
FIG. 3C shows the partially-hollowed out plug screw portion of the well tubing apparatus in a longitudinal view.
Figure 4A:
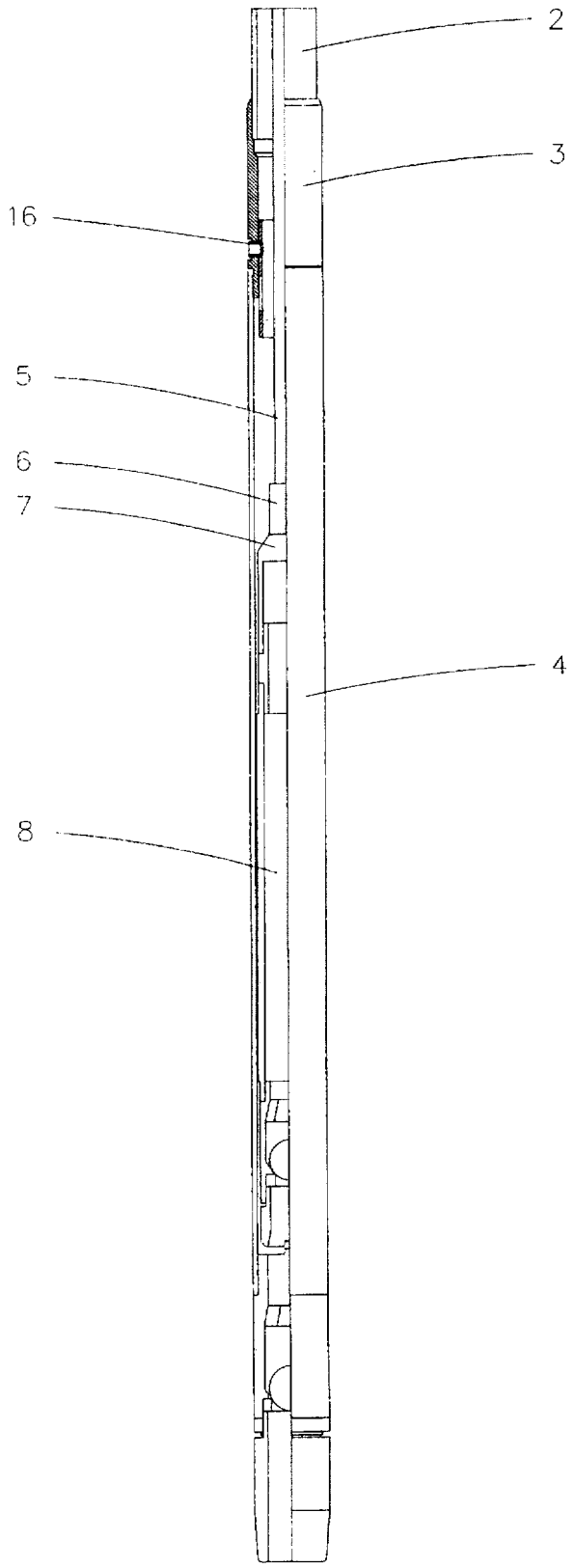
FIG. 4A shows the invention, prior to activation, in a longitudinal view with a quarter cutaway, as it would be attached to a tubing string and a big bore pump, and, a plunger assembly inside a big bore pump.
Figure 4B:
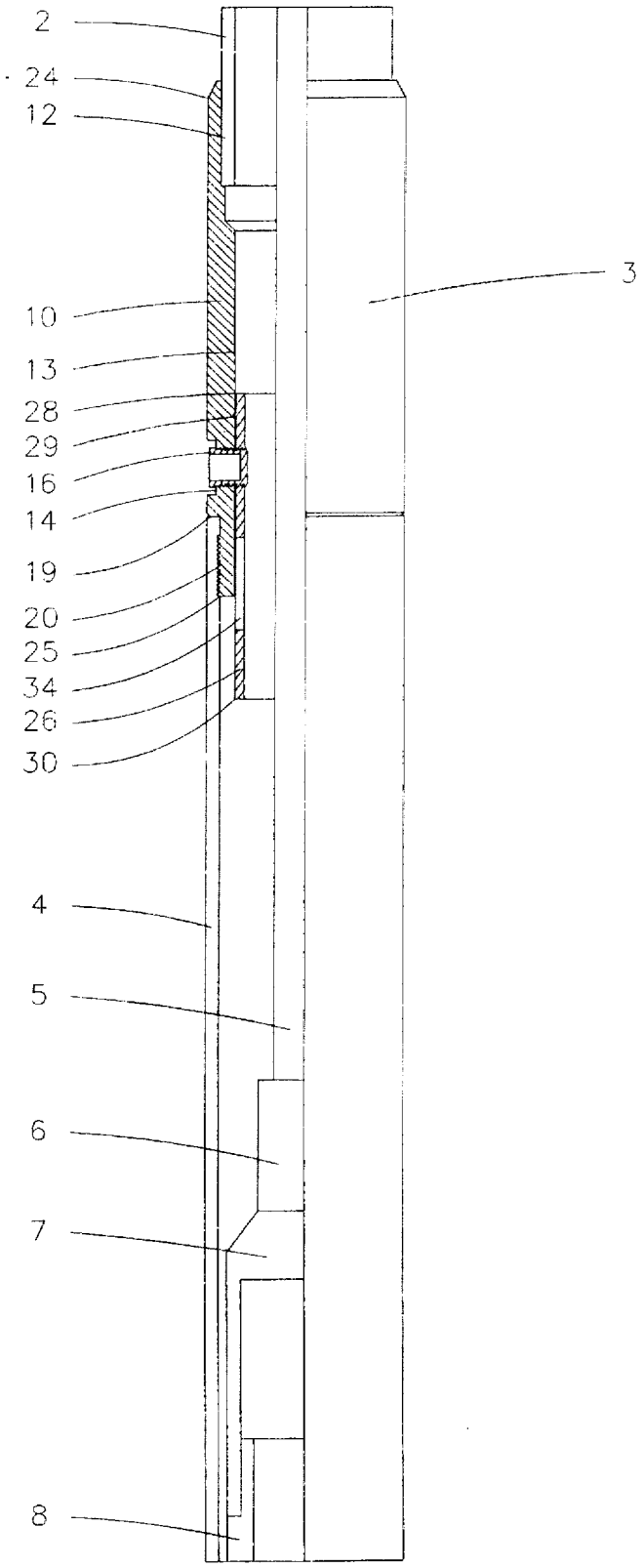
FIG. 4B shows the invention, prior to activation, in a longitudinal sectional view of the portion of FIG. 4A with a quarter cutaway from immediately above where the tubing screws into the top of the invention to just below the top of the plunger assembly.
Figure 4C:
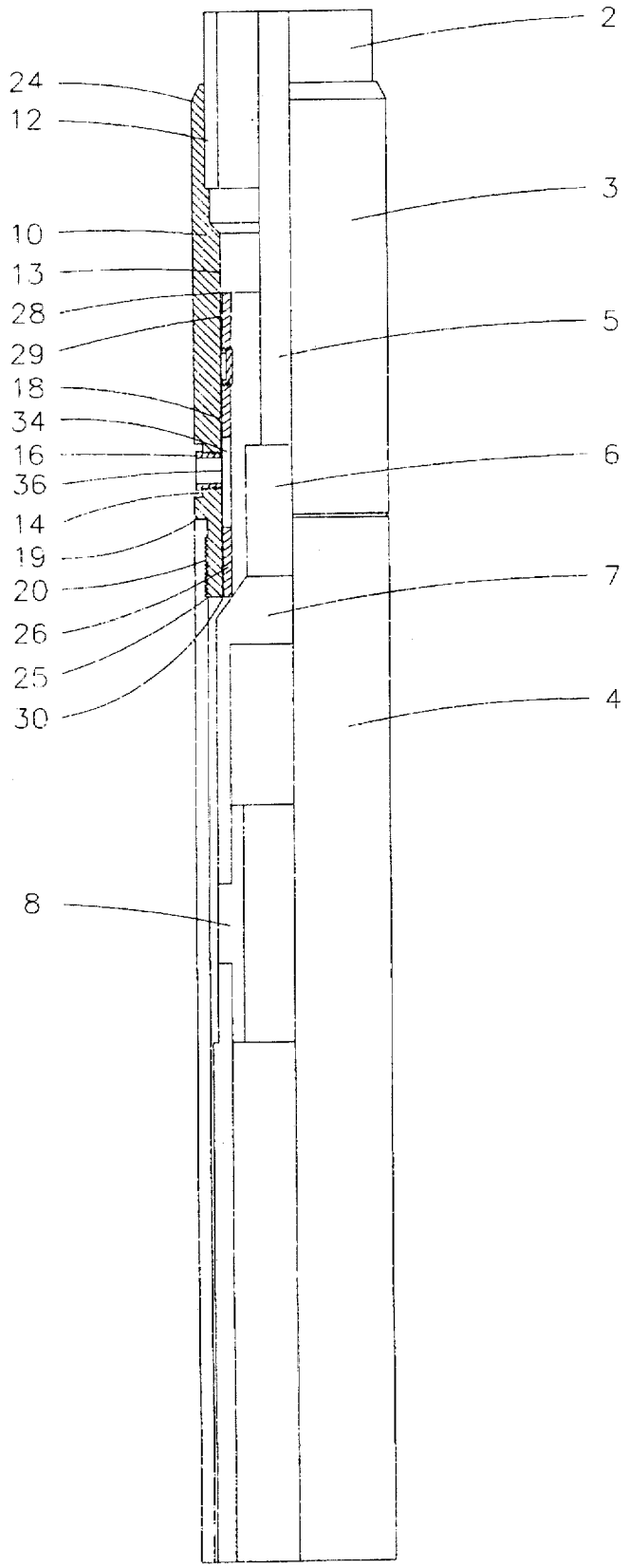
FIG. 4C shows the invention, as FIG. 4B, but after activation, wherein the partially-hollowed-out plug screw has been sheared by moderate upward force and the slot in the internal sleeve lines up with the hole created in the sheared partially-hollowed-out plug screw.

Referring now to the drawings, FIG. 1 and FIG. 2A show the well tubing drain apparatus 3, the invention, prior to activation and FIG. 2C shows a large-scale view of a portion of the apparatus prior to activation. FIG. 4A shows the invention, prior to activation, as it would appear attached to a tubing string 2 and a big bore pump 4. FIG. 4B shows a large-scale view of the invention, prior to activation, and attached to a tubing string 2 and a big bore pump 4. FIG. 4C shows a large-scale view of the invention, after activation, wherein the slotted internal sleeve 26 lines up with the sheared hollowed-out-plug screw 16 to create a drain hole 36. FIG. 3A, FIG. 3B and FIG. 3C show an external housing 10 and a slotted internal sleeve 26 and a partially-hollowed-out plug screw 16, which are the three parts needed to manufacture the present invention in its preferred embodiment.

Building of Apparatus

The external housing 10 is machined from cylindrical lengths of hollow metal pipe stock. The top portion of the hollow metal pipe stock is threaded with universal self-sealing threads on its inside diameter (I.D.) 12, so it will screw onto the bottom portion of a tubing string 2.

External housing I.D. 13 is bored from the bottom end 25 of housing 10 to a size slightly larger than the outside diameter (O.D.) 27 of the internal sleeve 26. This close tolerance allows sleeve 26 to be inserted into housing 10. The O.D. 11 of housing 10 is machined from the bottom end 25 of housing 10 to create threads 20.

Slightly above threads 20, a shoulder 19 is machined between the O.D. 11 of housing 10 and the diameter of threads 20 at the bottom of the housing 10. Shoulder 19 forms a metal seal between housing 10 and the top of a big bore pump 4.

A groove 18 is machined in a shape to accommodate the shape of a collet 29, and is located on I.D. 13 of housing 10 slightly above the threaded hole 22 in housing 10. Groove 18 accommodates collet 29 near the top end of the O.D. 27 of sleeve 26.

To complete housing 10, a flat 14 is milled slightly above shoulder 19. In the middle of flat 14, a hole 22 is drilled and threaded, using National Pipe Thread (NPT) standards.

A tapered steel plug screw 16 is partially hollowed out by drilling the center of plug screw 16 to a depth just short of its length. Plug screw 16 is of sufficient length to screw through housing 10 and sleeve 26. Plug screw 16 is self-sealing to prevent leakage. The result is a tapered, partially-hollowed-out, self-sealing plug screw 16 which, when the well tubing drain apparatus is activated, permits the fluid inside a tubing string to drain out 36.

The slotted internal sleeve 26 is made from a length of pipe stock with the O.D. 27 machined to a slightly smaller size than the bored I.D. 13 of housing 10. Several slots 31 are machined into sleeve 26 at its top 28. At the location of the collect 29, the O.D. 27 of sleeve 26 is slightly greater than the I.D. 13 of housing 10. After activation, collect 29 is above grove 18 and the resulting spring pressure will secure sleeve 26 in a firm position.

A window 34 is cut in sleeve 26. Window 34 can be a variety of shapes and sizes, but must be larger than threaded hole 22 in housing and hole 32 in sleeve. The preferred embodiment has one window 34; however one or more windows can be used. When two windows are cut in sleeve 26, they are 180° apart.

Above window 34 in sleeve 26, a threaded hole 32, using NPT standards, is drilled to the same diameter as threaded hole 22 in flat 14.

Assembling of Apparatus

Referring to FIG. 1 and FIG. 2A, which show the well tubing drain apparatus 3 prior to activation and sleeve 26 in its locked and secured position, and to FIG. 2C, which shows a large-scale view of the groove 18 and collet 29 portion of the apparatus, the apparatus is assembled as follows:

Put top end 28 of sleeve 26 into housing 10 from the bottom end 25 of housing 10, using sufficient force to drive sleeve 26 up into groove 18 of housing 10. Groove 18 accommodates collet 29 near the top end of the O. D. 27 of sleeve 26. Align threaded hole 32 in sleeve 26 and threaded hole 22 in flat 14 of housing 10. Refer to FIG. 2C which shows how collet 29 on sleeve 26 fits into groove 18. Tighten plug screw 16 into housing hole 22 and sleeve hole 32, so that sleeve 26 is secured to housing 10.

Plug screw 16 is self-sealing to prevent leakage from inside the well tubing drain apparatus into a well casing. The secured sleeve 26 can, in some variations, extend below housing 10.

Screw bottom end 25 of housing 10 into a big bore pump 4 with American Petroleum Institute standard threading 20. The bottom end 30 of secured sleeve 26 will slide onto the top of a big bore pump 4. A seal is formed when shoulder 19 is tightened to the top of a big bore pump 4. The top of a big bore pump 4 forms a metal seal with shoulder 19 of housing 10.

Screw the top end 24 of housing 10 onto the bottom of a tubing string 2. This creates a seal due to use of self-sealing threads 12 on I.D. 13 of housing 10.

FIG. 2B—The Apparatus After Activation

Now referring to FIG. 2B, a longitudinal sectional view of the well tubing drain apparatus, which shows the well tubing drain apparatus with slotted internal sleeve 26 in its activated position.

This activated position is accomplished by moderate upward force from a plunger 7 of a big bore pump 4 striking the bottom end 30 of sleeve 26. This plunger action is created by pulling up on the sucker rods 5 at the surface of a well. The force causes sleeve 26 to move upward, when plug screw 16 is sheared. When the shearing occurs, window 34 of sleeve 26 and the sheared plug screw hole 36 created in housing 10 by plug screw 16 being sheared, are properly aligned.

The activation of the apparatus forces collet 29 out of groove 18 in I.D. 13 of housing 10. Collet 29, which after activation is now above groove 18, has a greater O.D. than the I.D. of housing 10. Collet 29 acts in tandem with slots 31 in sleeve 26 to form spring pressure which secures sleeve 26 so it does not move upward or downward or rotate within housing 10.

Alignment occurs when the well tubing drain apparatus 3 is activated, allowing fluids located inside a tubing string 2 to drain into the casing of a well as the tubing string 2, and attached well tubing drain apparatus 3 and big bore pump 4 are pulled to the surface leaving fluids in the well.

FIG. 2C—Large Scale View of Groove and Collet

FIG. 2C shows a large-scale longitudinal sectional view of the groove 18 and collet 29 portion of the well tubing drain apparatus 3, referred to in the description of the apparatus prior to activation.

FIG. 3A, 3B, and 3C

Each of the three parts of the well tubing apparatus are shown separately as FIG. 3A, 3B, and 3C. FIG. 3A shows the external housing 10 of the well tubing apparatus in a longitudinal view. FIG. 3B shows the slotted internal sleeve 26 of the well tubing apparatus in a longitudinal view and the location of slots 31 and collet 29. FIG. 3C shows the partially-hollowed-out, self-sealing plug screw 16 of the well tubing apparatus in a longitudinal view.

FIG. 4A, 4B, and 4C

FIG. 4A and FIG. 4B show the well tubing apparatus 3, prior to activation, in a longitudinal view with a cutaway. FIG. 4A shows the invention attached to a tubing string 2 and a big bore pump 4 and the top of the plunger 7 inside a big bore pump 4. FIG. 4B shows the portion of FIG. 4A from just above where the tubing screws into the top of the invention, to just below the top of the plunger assembly 8.

FIG. 4C shows the well tubing apparatus 3, following activation, whereby the partially-hollowed-out plug screw 16 has been sheared and the window cut out 34 in the internal sleeve lines up with the sheared plug screw hole 36 created in the partially-hollowed-out plug screw 16.

Variations of Invention

While the above description contains many specificities, these should not be construed as limitations on the scope of this invention, but rather as an exemplification of one preferred embodiment thereof. Other variations, as follows, are primarily for the purpose of accommodating various pump types and sizes and varying well conditions. The external housing and internal sleeve can be machined to a length which is shorter or longer and can be a different diameter. The sleeve can be manufactured with more than one window. The housing can be machined with more than one flat. The collet and groove can be machined in various shapes and sizes. The apparatus can be machined without a collet on the sleeve and without a groove on the housing to accommodate a collet. Tolerance between the inside diameter of the housing the outside diameter of the sleeve can vary. For use on small pump sizes, self-sealing threads on the bottom of the housing can be used, and the housing can be manufactured without a flat and without a window.

What is claimed is:

1. A method for creating one or more drain holes inside a well bore in a well with a big bore pump, comprising the steps of:

a. positioning a well tubing drain apparatus at the top of a big bore pump;

b. screwing the bottom end of said apparatus into the top of said big bore pump;

c. positioning said apparatus now screwed onto top of said big bore pump so that a tubing string can be screwed into the top of said apparatus;

d. lowering said tubing string with attached said apparatus and said big bore pump inside a casing string to the desired operational depth for said big bore pump;

e. activating the well tubing drain apparatus when said big bore pump is not operating effectively;

f. triggering the activation of said apparatus by using moderate upward force on sucker rods in a well which are attached to a plunger of a big bore pump resulting in opening one or more drain holes in said apparatus;

g. recovering said apparatus from said tubing after said tubing string has been removed from a well.

2. A well tubing drain apparatus for opening one or more drain holes in a well bore in a well with a big bore pump, comprising:

a. a precision external housing machined to size specifications from cylindrical lengths of hollow metal tubing, and cut to an appropriate length, with the bottom end slightly smaller than the top end, including:

(i) one or more milled flats on the outside diameter of said cylindrical hollow metal tubing disposed to accommodate the location of one or more partially-hollowed-out plug screws;

(ii) one or more drilled and threaded self-sealing holes using National Pipe Thread standards in the one or more milled flats disposed to accommodate one or more partially-hollowed out plug screws;

(iii) self-sealing threads disposed in the inside diameter at the top of said cylindrical hollow metal tubing to accommodate a tubing string;

(iv) threads, disposed on the outside diameter at the bottom end of the external housing, to accommodate screwing of said housing into the top of a big bore pump;

(v) a shoulder disposed on the outside diameter of said housing located just above the threads at the bottom end, so that said shoulder will form a metal to metal seal with the top of a big bore pump when said housing is screwed into said pump;

(vi) a groove disposed on the inside diameter of said housing just above the threaded hole drilled into said housing to accommodate a collet which has been milled on the internal sleeve;

(vii) in some embodiments, no milled flat described in claim 2.a.(i) above will be cut, the threads described in claim 2.a.(iv) above will be self-sealing, no shoulder described in claim 2.a.(v) above will be milled, and no groove described in claim 2.a.(vi) above will be used;

b. a precision internal sleeve machined from cylindrical lengths of hollow tubing pipe including:

(i) a uniform outside diameter to create a close tolerance with the larger inside diameter of the external housing in claim 2.a. above, and cut to an appropriate length;

(ii) a collet milled near the top of said outside diameter of said sleeve which will rest in the groove disposed on the inside diameter of said housing as described in claim 2.a.(vi) above;

(iii) one or more slots cut into the top end of said sleeve;

(iv) one or more drilled self-sealing threaded holes using National Pipe Thread standards disposed to accommodate the location of one or more partially-hollowed-out plug screws in claim 2.c. below which are inserted from outside into said housing;

c. a precision self-sealing threaded steel pipe plug which is machined by drilling into its center starting at the top end and drilling to near its bottom end, thus, creating a tapered partially-hollowed-out plug screw.

3. The well tubing drain apparatus of claim 2 above wherein the internal sleeve is disposed in the well tubing drain apparatus so as to be moved only when a plunger of a big bore pump is raised by using moderate upward force.

4. The well tubing drain apparatus of claim 2 above wherein the internal sleeve within the external housing is secured and locked by use of one or more partially-hollowed-out plug screws at the time of installation of said apparatus above a big bore pump and prior to activation of said apparatus.

5. The well tubing drain apparatus of claim 2 above wherein the internal sleeve within the external housing has moved upward after having made contact with the top of a plunger of a big bore pump.

6. The well tubing drain apparatus of claim 2 above wherein the internal sleeve within the external housing has moved upward after having made contact with the top of a plunger of a big bore pump aligning the window in said sleeve and the drain hole created through the shearing of the partially-hollowed-out plug screw.

7. The well tubing drain apparatus of claim 2 above wherein the internal sleeve within the external housing has moved upward after having made contact with the top of a plunger of a big bore pump, aligning one or more windows in said sleeve with the drain holes created through the shearing of one or more partially-hollowed-out plug screws.

8. The well tubing drain apparatus of claim 2 above wherein the internal sleeve is disposed within the external housing so that when the slotted internal sleeve is secured and locked with one partially-hollowed-out plug screw no leakage will occur.

9. The well tubing drain apparatus of claim 2 above wherein the internal sleeve is disposed within the external housing so that when the slotted internal sleeve is secured and locked with two or more partially-hollowed-out plug screws no leakage will occur.

10. The well tubing drain apparatus of claim 2 above wherein a groove is on the inside diameter of said housing and a collet is on the outside diameter of the internal sleeve, and slots are cut on the top end of said sleeve, which when the apparatus is activated, causes said collet to pop up out of said groove, thereby creating spring pressure from the top of said sleeve, holding said sleeve from upward, downward or side-to-side movement.

* * * * *